US009327495B2

(12) United States Patent
Ohnishi

(10) Patent No.: US 9,327,495 B2
(45) Date of Patent: May 3, 2016

(54) INKJET PRINTER AND PRINTING METHOD USING SOLVENT-CONTAINING INK

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/288,405

(22) Filed: May 28, 2014

(65) Prior Publication Data

US 2014/0354744 A1 Dec. 4, 2014

(30) Foreign Application Priority Data

May 31, 2013 (JP) ..... 2013-115162

(51) Int. Cl.
*B41J 2/01* (2006.01)

(52) U.S. Cl.
CPC ..... *B41J 2/01* (2013.01); *B41J 2002/012* (2013.01)

(58) Field of Classification Search
CPC ..... B41J 2/01; B41J 2002/012
USPC ..... 347/102, 103
See application file for complete search history.

(56) References Cited

U.S. PATENT DOCUMENTS

| | | | | |
|---|---|---|---|---|
| 2007/0040885 | A1 | 2/2007 | Kusunoki | |
| 2007/0176995 | A1* | 8/2007 | Kadomatsu et al. | 347/103 |
| 2009/0079784 | A1* | 3/2009 | Chiwata et al. | 347/21 |
| 2009/0139432 | A1* | 6/2009 | Shikata et al. | 106/31.13 |
| 2009/0251522 | A1 | 10/2009 | Koike | |
| 2012/0199994 | A1* | 8/2012 | Richert et al. | 264/1.35 |
| 2013/0100216 | A1* | 4/2013 | Ohnishi | 347/102 |
| 2014/0204159 | A1* | 7/2014 | Dooley et al. | 347/103 |

FOREIGN PATENT DOCUMENTS

| | | |
|---|---|---|
| CN | 1290603 | 4/2001 |
| CN | 101544134 | 9/2009 |
| EP | 2095963 | 9/2009 |
| JP | 2001-152063 | 6/2001 |
| JP | 2007-112117 | 5/2007 |
| JP | 3936558 | 6/2007 |

OTHER PUBLICATIONS

"Office Action of China Counterpart Application", issued on Aug. 14, 2015, p. 1-p. 17, with English translation thereof, in which the listed references were cited.

* cited by examiner

*Primary Examiner* — Henok Legesse
(74) *Attorney, Agent, or Firm* — Jiang Chyun Intellectual Property Office

(57) ABSTRACT

The invention provides ways of appropriately performing image transfer printing. A printing apparatus for performing image transfer printing is provided that includes: a transfer belt provided as a transfer image forming member on which a transfer image is created; an inkjet head that creates the transfer image on the transfer belt; a counter heater provided as a heating member that heats the transfer belt; a transfer roller provided as a transfer member that transfers the transfer image to a medium; and a strong UV irradiator provided as an image fixing unit that fixes to the medium the image transferred to the medium. The inkjet head ejects ink droplets of an ink containing a solvent that is removed by heating with the counter heater. The ink has a viscosity of 50 mPa·sec or more after the solvent is removed by heating with the counter heater.

7 Claims, 5 Drawing Sheets

INKJET PRINTER AND PRINTING METHOD USING SOLVENT-CONTAINING INK

CROSS-REFERENCE TO RELATED APPLICATION

This application claims the priority benefit of Japan application serial no. 2013-115162, filed on May 31, 2013. The entirety of the above-mentioned patent application is hereby incorporated by reference herein and made a part of this specification.

BACKGROUND

1. Technical Field

The present invention relates to a printing apparatus, and a printing method.

2. Description of Background Art

An image forming apparatus, in which an image formed on an intermediate transfer rotating medium is transferred to a recording medium to achieve printing (see, for example, JP-A-2007-112117), is known. In the configuration disclosed in JP-A-2007-112117, an image is formed on an intermediate transfer rotating medium with a UV curable ink having predetermined spectral absorption properties, and the ink is brought to a partially cured state by irradiation of a UV light of a predetermined wavelength. The image formed by the partially cured ink on the intermediate transfer rotating medium is then transferred to a recording medium. After the transfer, the ink is permanently cured by irradiation of the UV light of a predetermined wavelength.

However, the image transfer by such a method requires, for example, accurately controlling the intensity and the duration of the UV irradiation to adequately bring the ink to the partially cured state before the transfer. Another possible drawback is that the spectral absorption properties of the ink, depending on its relationship with the irradiation wavelength of the UV light used, might limit the irradiation conditions of the partially cured ink, or might pose difficulties in adequately bringing the ink to the partially cured state. Depending on the irradiation wavelength of the UV light, it might be also difficult to use inks other than UV curable inks of specific spectral absorption properties.

In partial curing of UV curable ink dots by UV irradiation, the curing will proceed faster on the dot surface than inside the dot because the surface is directly exposed to the UV light. For example, partial curing to make the inside of the ink dots suitable for transfer may overcure the ink dot surface. The overcuring of the ink dot surface may lower the adhesion of the dot surface, and the ink may not be properly transferred to a medium. Conversely, the ink dots may not be sufficiently cured inside by partial curing to make the ink dot surface suitable for transfer. In the transfer step, for example, the ink may remain in a partially liquid state when the inside of the ink dots is insufficiently cured, and ink separation may occur in the liquid portion of the ink. This may result in ink transfer failure, or may cause ink bleeding after the transfer.

SUMMARY

In the foregoing image transfer method, therefore, partial curing of the ink may not be performed properly for adequate image transfer. That is, it may not be possible with the foregoing method to appropriately perform image transfer printing. Accordingly, there is a need for a more appropriate method of image transfer printing. The present invention provides a printing apparatus and a printing method as a solution to the foregoing problems.

The inventor of the present application conducted intensive studies to find more appropriate ways of transferring an image, and thought of using a solvent-containing ink instead of partially curing a UV curable ink, and performing the transferring after at least partially removing the solvent in the ink. It was found that the transferring can be appropriately achieved without causing problems such as bleeding when the ink has a sufficiently high viscosity after the solvent removal. The present invention can solve the foregoing problems with the following configurations.

Configuration 1

A printing apparatus for performing an image transfer printing, and the printing apparatus including: a transfer image forming member on which a transfer image, which is an image to be transferred to a medium, is created; an inkjet head that ejects ink droplets to the transfer image forming member using an inkjet scheme, so as to create the transfer image on the transfer image forming member; a heating member that heats the transfer image forming member; a transfer member that transfers the transfer image created on the transfer image forming member to the medium; and an image fixing unit that fixes the image which is transferred to the medium with the transfer member to the medium, wherein the inkjet head ejects ink droplets of an ink containing a solvent that is removed by heating with the heating member, and wherein the ink has a viscosity of 50 mPa·sec or more after the solvent is removed by heating with the heating member, from the ink droplets landed on the transfer image forming member.

The ink viscosity may be, for example, a viscosity under room temperature (25° C.) condition. In the state before the removal of the solvent, the ink has, for example, a viscosity that makes the ink ejectable through the inkjet head. Specifically, the ink viscosity before the removal of the solvent is, for example, less than 20 mPa·sec. The transfer image forming member is, for example, a member used for transfer such as a transfer belt or a transfer drum. Preferred as the heating member is, for example, a heater. Preferred as the transfer member is, for example, a roller or a heating roller.

With this configuration, for example, because the ink ejected from the inkjet head contains a solvent and thus has a reduced viscosity, the inkjet head can accurately and appropriately eject ink droplets. Further, the ink can have an increased viscosity and thus can be brought to a suitably transferable state upon removing the ink solvent with the heating member after the ink droplets have landed on the transfer image forming member. It is also possible to appropriately prevent ink bleeding on the transfer image forming member and the like when the ink has a viscosity of 50 mPa·sec or more after the removal of the solvent.

The transfer can be appropriately brought to completion upon fixing to the medium the image transferred to the medium with the image fixing unit. It is thus possible with the foregoing configuration to, for example, appropriately transfer an image created in the inkjet scheme. This makes it possible to appropriately perform image transfer printing.

The ink landed on the transfer image forming member should preferably have a sufficiently high viscosity while maintaining adhesion on the ink surface after the removal of the solvent with the heating member. The viscosity of the ink in this state is 50 mPa·sec or more, preferably 100 mPa·sec or more, more preferably 500 mPa·sec or more. The ink viscosity in this state may be, for example, 1,000 mPa·sec or more. With this configuration, for example, problems such as ink bleeding can be more appropriately prevented. This makes it possible to more appropriately perform image transfer printing.

Configuration 2

The ink may have a viscosity that makes the ink non-bleedable on the transfer image forming member and transferable to the medium after the solvent is removed by heating with the heating member from the ink droplets landed on the transfer image forming member. With this configuration, for example, problems such as ink bleeding can be more appropriately prevented. This makes it possible to more appropriately perform image transfer printing.

As used herein, "non-bleedable on the transfer image forming member" means that, for example, the ink can be considered as being not bleeding at the accuracy required for the printing resolution. By "transferable to the medium", it means that, for example, the ink viscosity does not completely fix the ink to the transfer image forming member, but allows the transfer to be appropriately performed with the transfer member at the accuracy required for the printing resolution.

Configuration 3

The ink may be a solvent UV ink containing a UV polymerizable substance and an organic solvent, the organic solvent being removed by heating with the heating member from the ink droplets of the ink landed on the transfer image forming member. The image fixing unit may be a UV light source that emits a ultraviolet light, and the image transferred to the medium with the transfer member may be UV irradiated with the image fixing unit to clue the ink on the medium.

With this configuration, the organic solvent in the ink is removed by heating with the heating member after the ink droplets have landed on the transfer image forming member. This increases the viscosity of the ink on the transfer image forming member. With the foregoing configuration, the ink is heated to increase the ink viscosity, and the surface overcuring that poses a problem in the transfer is less likely to occur than when, for example, the UV curable ink is UV irradiated to bring the ink to a partially cured state. Further, because removing the organic solvent in the ink does not cure the ink, the ink viscosity can sufficiently increase upon sufficiently removing the organic solvent. It is therefore possible with the foregoing configuration to, for example, appropriately and sufficiently increase the viscosity of the ink on the transfer image forming member. This makes it possible to appropriately transfer the image to the medium.

After the image is transferred to the medium, the image fixing unit irradiates the ink with a UV light, and the ink can appropriately cure on the medium. The image can thus be appropriately fixed to the medium. It is therefore possible with the configuration to, for example, appropriately perform image transfer printing.

As used herein, "removing the organic solvent in the ink with the heating member" does not necessarily mean that the organic solvent is completely removed. For example, the organic solvent may be removed to a sufficient extent that makes the ink viscosity suitable for transfer.

Configuration 4

The ink may be a latex ink, and the image fixing unit may heat the medium to fix to the medium the image transferred to the medium. In this case, for example, the heating member at least partially evaporates the solvent in the ink to increase the ink viscosity on the transfer image forming member. The image fixing unit, for example, heats the medium to dry the ink on the medium. As used herein, "to dry the ink on the medium" with the image fixing unit means, for example, sufficiently drying the ink to achieve the purpose of fixing the image to the medium.

The latex ink is, for example, an aqueous latex ink. The aqueous latex ink is, for example, an ink in which an aqueous emulsion or an aqueous suspension of a resin has been formed. The ink may be, for example, an ink that contains water or a hydrophilic organic solvent, and a resin emulsified or suspended in the water or the hydrophilic organic solvent.

After intensive studies, the inventor of the present application found that partial evaporation of the solvent is sufficient, and the solvent does not need to be completely evaporated to bring the latex ink to a sufficiently high viscosity state. It is therefore possible with the foregoing configuration to, for example, appropriately and sufficiently increase the viscosity of the ink on the transfer image forming member with the heating member. This makes it possible to appropriately transfer the image to the medium.

For example, the ink on the medium can be dried to appropriately fix the image by heating the medium with the image fixing unit after the image is transferred. It is therefore possible with the foregoing configuration to, for example, appropriately perform image transfer printing.

Configuration 5

The ink may be an ink containing a binder resin and a solvent, and the heating member may at least partially evaporate the solvent contained in the ink to increase the viscosity of the ink on the transfer image forming member. The ink may be, for example, a known latex ink. An ink of a configuration different from those of known latex inks may also be used, provided that the ink has the foregoing characteristics.

After intensive studies, the inventor of the present application found that even the viscosity of such an ink can be sufficiently increased by partially evaporating the solvent contained in the ink. It is therefore possible with the foregoing configuration to, for example, appropriately and sufficiently increase the viscosity of the ink on the transfer image forming member with the heating member. This makes it possible to appropriately transfer the image to the medium.

In the foregoing configuration, for example, the image fixing unit heats the medium to fix the image to the medium. The image fixing unit may fix the image to the medium using a method other than heating (for example, UV irradiation), depending on the properties of the binder resin used. It is possible with this configuration to, for example, appropriately fix the image to the medium. This makes it possible to appropriately perform image transfer printing, for example.

Configuration 6

The binder resin in the ink may be dispersed as a dispersoid in the solvent which serves as a dispersion medium, and a colorant may be dispersed or dissolved in particles of the binder resin. With this configuration, for example, the viscosity of the ink on the transfer image forming member can be appropriately and sufficiently increased by heating with the heating member. This makes it possible to appropriately transfer the image to the medium.

In the inks of the foregoing configurations 5 and 6, the binder resin particles have an average particle diameter of preferably 300 nm or more, more preferably 400 nm or more. With this configuration, it is possible to appropriately prevent, for example, ink bleeding on the transfer image forming member, excess aggregation of the binder resin particles, and deterioration of the colorant while appropriately maintaining the ejection stability of the ink through the inkjet head. The binder resin particles may have an average particle diameter of, for example, 800 nm or more. With this configuration, for example, ink bleeding on the transfer image forming member can be more reliably prevented.

Preferably, the average particle diameter of the binder resin particles in the ink is no greater than 1/10 of the nozzle diameter of the inkjet head. With this configuration, for example, the ejection stability can be more appropriately improved. Preferably, the binder resin particles in the ink are substantially in the shape of a sphere, an ellipsoid, or a disc. With this configuration, for example, the ink ejection stability can be more appropriately improved.

The binder resin particles in the ink may be particles formed by emulsion polymerization or suspension polymerization of a binder resin material monomer and the colorant. With this configuration, for example, the binder resin particles can easily be formed into substantially the shape of a sphere or an ellipsoid. The ejection stability through the inkjet head also can be appropriately maintained, for example, even when the particle size of the binder resin is increased.

The average content ratio of the binder resin and the colorant in the binder resin particles of the ink is preferably 20:80 to 95:5 by weight. With this configuration, for example, particle precipitation of the binder resin can be more appropriately suppressed. The average content ratio is more preferably 75:25 to 95:5, further preferably 65:35 to 85:15.

The average particle diameter of the colorant in the ink is preferably 50 nm or less. With this configuration, for example, the ink coloring properties further improves, and more vivid printing can be performed. Because the colorant is encapsulated in the binder resin particles, the lightfastness of the ink can appropriately improve even when the colorant average particle diameter is as small as 50 nm or less.

In the ink, for example, an additional resin having a glass transition point different from that of the binder resin may be dissolved in the dispersion medium. With this configuration, for example, the ink viscosity can be more appropriately adjusted. Further, for example, when the ink on the medium is dried with the image fixing unit to form a coating by the binding of the binder resin, the additional resin can serve as a binder, and the binder resin can more strongly bind to each other. This makes it possible to more appropriately fix the ink on the medium.

Configuration 7

The binder resin may be a heat-curable high molecular weight compound. The heating member may heat the transfer image forming member at a temperature that does not cure the binder resin in the ink on the transfer image forming member. The image fixing unit may heat the medium at a temperature equal to or greater than a curing temperature of the binder resin in the ink on the medium.

With this configuration, the viscosity of the ink on the transfer image forming member can be appropriately brought to a suitably transferable state by heating the transfer image forming member with the heating member in a temperature range that does not cause the curing. The image can be appropriately fixed to the medium by heating the medium to a higher temperature with the image fixing unit after the image is transferred to the medium. It is possible with this configuration to, for example, appropriately perform image transfer printing.

For example, the image fixing unit heats and cures the ink binder resin to fix the image to the medium. The image fixing unit may heat the binder resin at a higher temperature to melt the cured binder resin, and fix the image to the medium.

Configuration 8

The heating member may heat the ink on the transfer image forming member to a temperature below a melting temperature that melts the binder resin, and the image fixing unit may heat the ink on the medium to a temperature equal to or greater than the melting temperature. With this configuration, for example, the image fixing unit can more strongly fix the image to the medium. This makes it possible to more appropriately perform image transfer printing, for example.

Configuration 9

The binder resin may be a high molecular weight compound that is cured by being irradiated with a light, and the image fixing unit may irradiate the medium with a light to cure the binder resin in the ink on the medium. The light is, for example, a UV light.

With this configuration, for example, the viscosity of the ink on the transfer image forming member can be appropriately brought to a suitably transferable state with the heating member, without curing the ink. The image can then be appropriately fixed to the medium upon curing the ink after the ink is transferred to the medium. It is therefore possible with this configuration to more appropriately perform image transfer printing, for example.

Configuration 10

The medium may be a paper. With this configuration, a desired image can be accurately and appropriately printed on a paper medium.

One may conceive, for printing a paper medium, that the inkjet head should eject ink droplets directly to the medium for printing, as commonly practiced in the art. However, such a method may fail to perform accurate printing with known inks.

For example, when a common solvent ink is used, the ink bleeds when its ink droplets are directly ejected onto a paper medium. Direct printing of a paper medium with a solvent ink is therefore difficult. When a common aqueous ink is used, for example, use of a specialty paper coated with an ink receptive layer is generally necessary to avoid medium wrinkling and ink bleeding. Direct printing with an aqueous ink is therefore not always suitable for common paper media (such as a plain paper).

When a common UV curable ink is used, some of the monomers in the ink droplets directly ejected onto a paper medium may permeate the paper fiber, and remain as uncured monomers. Such uncured monomers (residual monomers) are often undesirable in terms of their effect on the environment and users. Direct printing with a UV curable ink may produce ink dots that are noticeably granular, and may fail to appropriately produce glossy prints. Indeed, direct printing of a paper medium with a UV curable ink is not always suitable.

On the other hand, the transfer printing using the foregoing configurations can appropriately suppress ink bleeding. The problems of medium wrinkling and residual monomers are also unlikely to occur. Further, with use of a transfer roller or the like, the transfer printing can appropriately and sufficiently flatten (smooth) the ink dots transferred to the medium. This makes it possible to appropriately produce, for example, glossy prints. It is therefore possible with the foregoing configuration to, for example, accurately and appropriately print a desired image on a paper medium.

Further, because the bleeding and wrinkling problems are unlikely to occur in the foregoing configuration, a thick ink layer can be formed with sufficient amounts of ink. This makes it possible to sufficiently increase the thickness of the ink layer for higher density printing.

Configuration 11

A printing method for performing image transfer printing, and the printing method including: ejecting ink droplets with an inkjet head using an inkjet scheme to a transfer image forming member on which a transfer image, which is an image to be transferred to a medium, is created, and creating the transfer image on the transfer image forming member; heating the transfer image forming member with a heating member; transferring the transfer image created on the transfer image forming member to the medium using a transfer member; and fixing the image which is transferred to the medium with the transfer member to the medium by using an image fixing unit, wherein the inkjet head ejects ink droplets of an ink containing a solvent that is removed by heating with the heating member, and wherein the ink has a viscosity of 50 mPa·sec or more after the solvent is removed by heating with the heating member, from the ink droplets landed on the transfer image forming member. The same effects obtained in, for example, configuration 1 also can be obtained with this configuration.

The present invention can appropriately perform image transfer printing, for example.

BRIEF DESCRIPTION OF THE DRAWINGS

FIGS. 3A and 3B are diagrams representing a third exemplary configuration of the printing apparatus, in which FIG. 3A shows an exemplary configuration of a binder resin contained in the ink of this example, and FIG. 3B is a flowchart representing an example of a producing method of the ink of this example.

FIGS. 4A to 4C are diagrams representing a state of the ink in each step during a printing process, in which FIG. 4A shows a state of the ink before landing on a transfer belt, FIG. 4B shows a state of the ink landed on the transfer belt and heated by a counter heater, and FIG. 4C shows a state of the ink after heating with a fixing heater at a temperature that melts the cured binder resin.

FIGS. 5A to 5C represent a state of ink in each step during a printing process when a high molecular weight compound that is cured by UV irradiation is used as the binder resin, in which FIG. 5A represents a state immediately after the ink has landed on the transfer belt, FIG. 5B represents a state after the ink has been heated with the counter heater, and FIG. 5C represents an ink state after UV irradiation with a strong UV irradiator or the like.

DESCRIPTION OF THE EMBODIMENTS

Figure 1:
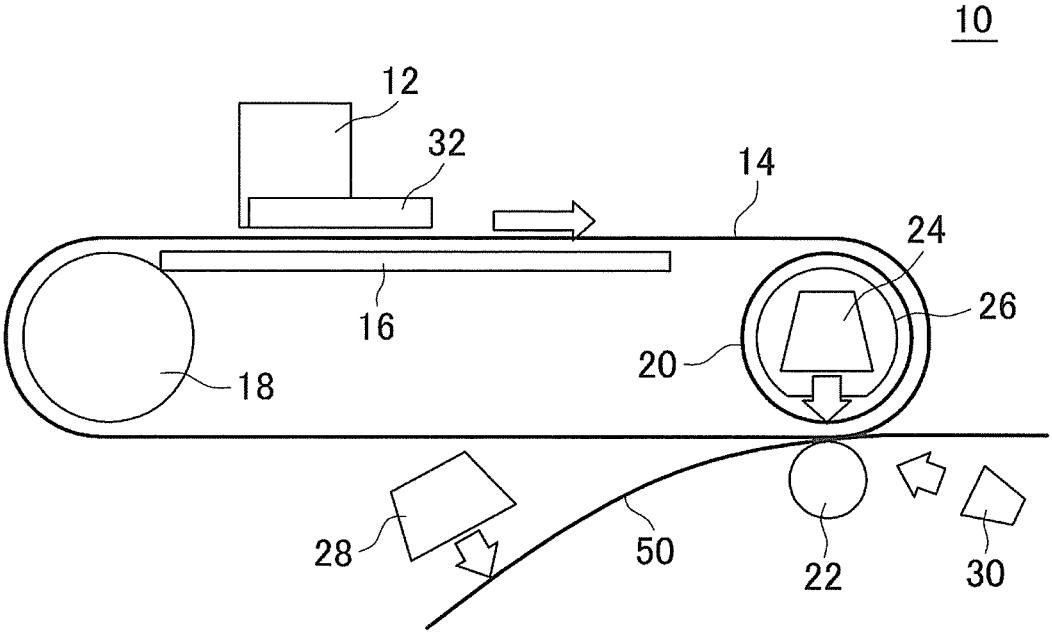
FIG. 1 is a diagram representing a first exemplary configuration of a printing apparatus according to an embodiment of the present invention.

Embodiments of the present invention are described below with reference to the accompanying drawings. FIG. 1 represents a first exemplary configuration of a printing apparatus 10 according to an embodiment of the present invention. The printing apparatus 10 is a printing apparatus that performs an image transfer printing. For example, the printing apparatus 10 prints a medium 50, for example, such as a paper, using an image transfer printing. Here, "printing" means, for example, forming an image (such as characters and graphic patterns) on the medium 50. The printing apparatus 10 also can be deemed as an image forming apparatus that forms an image on the medium 50 by using a digital offset printing.

The medium 50 is, for example, a plain paper. The medium 50 may be, for example, a paper without an ink receptive layer. The medium 50 also may be a non-paper medium. For example, the medium 50 may be any of various media made from materials such as a plastic, resin, and metal.

In the present embodiment, the printing apparatus 10 includes an inkjet head 12, a transfer belt 14, a counter heater 16, a weak UV irradiator 32, belt driving rollers 18 and 20, a transfer roller 22, strong UV irradiators 24, 28, and 30, and a reflection tube 26.

The inkjet head 12 is a printing head that ejects ink droplets using an inkjet scheme. In the present embodiment, the inkjet head 12 ejects ink droplets onto the transfer belt 14 to create thereon a transfer image, which is an image to be transferred to the medium 50.

In the present embodiment, the inkjet head 12 ejects ink droplets of a solvent UV ink. The solvent UV ink is an example of the inks containing a solvent that is removed by being heated with a heater, and contains a UV polymerizable substance, and an organic solvent. The UV polymerizable substance is, for example, a monomer or an oligomer that polymerizes by irradiation of a UV light. The organic solvent contained in the ink is an example of the ink solvent. The organic solvent is preferably a volatile organic solvent.

For color printing, the printing apparatus 10 includes, for example, a plurality of inkjet heads 12 that each ejects ink droplets of a different color. For example, the inkjet heads 12 eject ink droplets of different CMYK colors, respectively. Preferred for use as the solvent UV ink in the present embodiment is, for example, any known solvent UV ink having certain properties, such as viscosity, as described below. Before being ejected from the inkjet heads 12, the inks have a viscosity of, for example, less than 20 mPa·sec. With this configuration, for example, the inkjet heads 12 can appropriately eject ink droplets. For example, the inkjet heads 12 eject ink droplets to any location on the transfer belt 14 in the main scan direction during a main scan operation. Specifically, ink droplets are ejected as the inkjet heads 12 move in the main scan direction orthogonal to the moving direction of the transfer belt 14.

The transfer belt 14 is a belt member on which a transfer image is created. For example, the transfer belt 14 may be realized preferably by a configuration that uses a metal belt or some other high-rigidity belt having a surface processed by a mold release treatment. The release treatment may preferably be performed by, for example, a process that coats the belt surface with a fluorine, silicone, or polyimide resin.

In the present embodiment, the transfer belt 14 moves in the direction of the arrow in the figure during intervals of the main scan operation of the inkjet heads 12, so as to successively present different belt portions to the inkjet heads 12 facing the transfer belt 14. The inkjet heads 12 can thus create a transfer image at any location on the transfer belt 14.

In the present embodiment, the transfer belt 14 is an example of the transfer image forming member on which a transfer image is formed. As a variation of the configuration of the printing apparatus 10, for example, a transfer drum or the like may be used as the transfer image forming member, instead of the transfer belt 14.

The counter heater 16 is a heating member that heats the transfer belt 14, and is provided to face the inkjet heads 12 across the transfer belt 14 to heat any location on the transfer belt 14 where the ink droplets have landed. In the present embodiment, the heat of the counter heater 16 removes the organic solvent in the ink, after the ink droplets ejected from the inkjet heads 12 have landed on the transfer belt 14.

In the present embodiment, the ink has a viscosity of 50 mPa·sec or more after the organic solvent is removed by the counter heater 16. The ink viscosity is the viscosity as measured in the environment in which the printing apparatus 10 is used, and may be, for example, a viscosity under room temperature (25° C.) condition. With this configuration, for example, the ink viscosity can increase immediately after the ink has landed on the transfer belt 14, and ink bleeding can be appropriately prevented. The solvent UV ink used in the present embodiment does not cure unless exposed to a strong UV light above a predetermined intensity level. Thus, the ink after the removal of the organic solvent with the counter heater 16 does not bleed on the transfer belt 14, and has a viscosity that enables transfer to the medium 50.

As used herein, "removing the ink organic solvent with the counter heater 16" does not necessarily mean that the organic solvent is completely removed. For example, the organic solvent may be removed only to a sufficient extent that makes the ink viscosity suitable for transfer.

The ink after the removal of the organic solvent should preferably have a sufficiently high viscosity while maintaining adhesion on the ink surface. The viscosity of the ink in such a state is preferably 50 mPa·sec or more, more preferably 100 mPa·sec or more. With this configuration, for example, problems such as ink bleeding can be more appropriately prevented. This makes it possible to more appropriately perform image transfer printing.

The weak UV irradiator 32 is a light source with which the ink landed on the transfer belt 14 is irradiated with a weak UV light. The irradiation with the weak UV light cures the ink to a gelatinous state. That is, the weak UV irradiator 32 further increases the viscosity of the ink on the transfer belt 14. With this configuration, for example, the ink on the transfer belt 14 can be brought to a state that is more suited for transfer. Preferred for use as the weak UV irradiator 32 is, for example, a UV LED.

Excessive UV irradiation with the weak UV irradiator 32 may cause overcuring, and make the ink unsuitable for transfer, for example. In the present embodiment, however, the counter heater 16 increases the ink viscosity, and the bleeding problem is unlikely to occur despite the weakness of the UV irradiation by the weak UV irradiator 32. It is accordingly preferable that the intensity of the UV irradiation by the weak UV irradiator 32 be appropriately kept low so as to prevent overcuring. The weak UV irradiator 32 may be omitted, provided that the counter heater 16 alone can sufficiently increase the ink viscosity. It is also possible to use, for example, an LED that produces a UV light or blue light of a relatively long wavelength (for example, wavelength of about 385 nm to 460 nm), instead of using the weak UV irradiator 32. In this case, for example, problems such as surface overcuring of the UV ink can be appropriately prevented with the long wavelength UV light.

The belt driving rollers 18 and 20 are rollers that move the transfer belt 14. The belt driving rollers 18 and 20 are disposed on the inner side of the loop of the transfer belt 14, and rotate to move the transfer belt 14 in a predetermined direction. In the present embodiment, the belt driving roller 18 is a driving roller for driving the transfer belt 14. The belt driving roller 20 is a light-transmissive roller, housing the strong UV irradiator 24 and the reflection tube 26 inside. Preferred for use as the belt driving roller 20 is, for example, a transparent roller, or a mesh roller.

For example, the belt driving roller 18 and/or the belt driving roller 20 may also function to heat the transfer belt 14. The belt driving roller 20 may be a driving roller that drives the transfer belt 14 together with the belt driving roller 18, or a driven roller that is driven to rotate by the movement of the transfer belt 14.

The transfer roller 22 is a roller that presses the medium 50 against the transfer belt 14. In the present embodiment, the transfer roller 22 is an example of the transfer member, and transfers the transfer image created on the transfer belt 14 to the medium 50 by the pressing. The transfer roller 22 may be, for example, a heating roller that heats and presses the medium 50. The transfer roller 22 is disposed to face the belt driving roller 20 with the transfer belt 14 and the medium 50 in between. It is possible with this configuration to, for example, more appropriately press the medium 50.

The strong UV irradiator 24 is a light source with which the transferred ink on the medium 50 is cured by UV irradiation. In the present embodiment, the strong UV irradiator 24 is an example of the image fixing unit, and, for example, irradiates the medium 50 with a UV light of a higher intensity than that of the weak UV irradiator 32 to cure the ink on the medium 50. After the curing by the strong UV irradiator 24, the image transferred to the medium 50 with the transfer roller 22 is fixed to the medium 50. Preferred for use as the strong UV irradiator 24 is, for example, a UV LED that produces a UV light of a wavelength of about 350 nm to 450 nm.

In the present embodiment, the strong UV irradiator 24 is housed inside the belt driving roller 20, and irradiates the medium 50 with a UV light through the belt driving roller 20 and the transfer belt 14. With this configuration, an image can be quickly fixed after being transferred to the medium 50. Further, because the strong UV irradiator 24 is housed inside the belt driving roller 20, it is possible to appropriately save the installation space for the strong UV irradiator 24.

The reflection tube 26 is a tubular member that reflects the UV light produced by the strong UV irradiator 24. Together with the strong UV irradiator 24, the reflection tube 26 is housed inside the belt driving roller 20, and reflects the UV light from the strong UV irradiator 24 toward the medium 50. With this configuration, for example, it is possible to appropriately improve the use efficiency of the UV light. The reflection tube 26 can thus strengthen the UV light, and appropriately increase the intensity of the UV light reaching the medium 50.

The strong UV irradiators 28 and 30 are light sources that produce a strong UV light similar to that produced by the strong UV irradiator 24. The strong UV irradiators 28 and 30 emit a strong UV light from different locations from the strong UV irradiator 24. For example, in the present embodiment, the strong UV irradiator 28 exposes the fixed image on the medium 50 to a UV light in the downstream in the transport direction of the medium 50 after the image transfer by the transfer roller 22. The strong UV irradiator 30 emits a UV light from the transfer roller 22 side, irradiating the medium 50 at the position being pressed by the transfer roller 22. With this configuration, for example, the ink on the medium 50 can be more reliably cured. This makes it possible to more reliably fix to the medium 50 the image transferred to the medium 50.

As described above, in the present embodiment, a plurality of strong UV irradiators, 24, 28, and 30, is used as light sources that irradiate the medium 50 with a UV light. However, one or more of these irradiators may be omitted in a variation of the configuration of the printing apparatus 10. For example, the strong UV irradiator 24 may be omitted when the strong UV irradiator 24 cannot be easily housed inside the belt driving roller 20. In this case, for example, one or both of the strong UV irradiators 28 and 30 serve as the image fixing unit. It is also possible to omit one or both of the strong UV irradiators 28 and 30, depending on the required UV light intensity for fixing the image. It may also be possible to omit both the strong UV irradiator 24 and the strong UV irradiator 30, and use the strong UV irradiator 28 as the sole image fixing unit.

In the present embodiment, for example, the inkjet heads 12 can appropriately and accurately eject ink droplets using the solvent UV ink that contains an organic solvent and has a low viscosity. Further, the ink droplets landed on the transfer belt 14 can be brought to a suitably transferable state by increasing the ink viscosity through the removal of the ink organic solvent with the counter heater 16. Ink bleeding can be appropriately prevented on the transfer belt 14 when the ink has a viscosity of 50 mPa·sec or more after the removal of the organic solvent.

The transfer can be appropriately brought to completion upon fixing to the medium 50 the image transferred to the medium 50 with the strong UV irradiator 24 or the like. It is thus possible in the present embodiment to, for example, appropriately transfer an image created in the inkjet scheme. This makes it possible to appropriately perform the image transfer printing.

In the present embodiment, the counter heater 16 is used to heat the ink and increase the ink viscosity, and the surface overcuring that poses a problem in the transfer is less likely to occur than when, for example, the UV curable ink is UV irradiated to bring the ink to a partially cured state. Further, because removing the ink organic solvent does not cure the ink, the ink viscosity can sufficiently increase upon sufficiently removing the organic solvent.

Because of the configuration using the solvent UV ink and the counter heater 16, the intensity and the quantity of the UV irradiation can be sufficiently kept low even when, for example, the weak UV irradiator 32 is used for the irradiation with a weak UV light. This makes it possible to appropriately prevent overcuring of the ink before the transfer. It is therefore possible in the present embodiment to, for example, appropriately and sufficiently increase the viscosity of the ink on the transfer belt 14. This makes it possible to appropriately transfer the image to the medium 50.

Because the configuration employs an image transfer printing, the medium 50 will not wrinkle by absorbing the solvent, even when, for example, a paper medium is used. Further, because the ink viscosity can be sufficiently increased before the ink is transferred to the medium 50, an oligomer of a large molecular weight can be used to prevent the problem of for example, residual monomers. It is therefore possible in the present embodiment to appropriately perform accurate printing using, for example, a plain paper as the media 50. As an example, a paper label may be appropriately used as the medium 50.

For example, smooth, high-glossy prints with a thin ink layer also can be made by the foregoing image transfer printing as in the common offset printing, making it possible to appropriately realize a digital offset printing. Further, because the bleeding and wrinkling problems are unlikely to occur, a thick ink layer can be formed with sufficient amounts of ink. This makes it possible to appropriately perform a high-density printing.

Because the printing is by image transfer in the configuration of the present embodiment, it is possible to appropriately print, for example, various types of non-paper media (for example, such as non-absorbable media). Specifically, the medium 50 can be accurately and appropriately printed even when the medium 50 is made from materials, for example, such as a plastic, resin, and metal.

Figure 2:
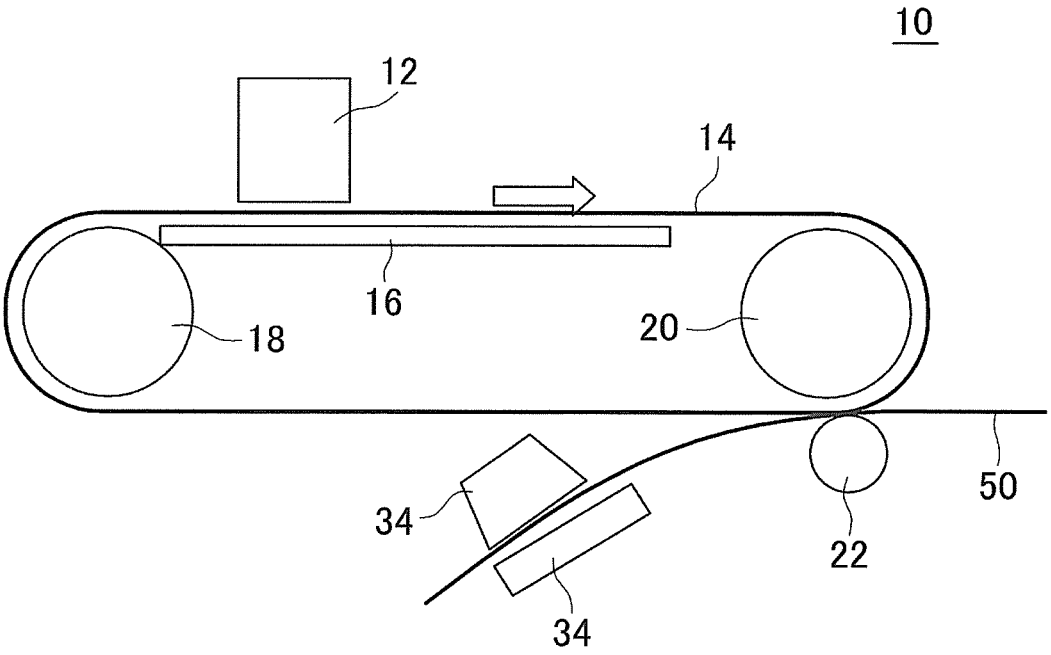
FIG. 2 is a diagram representing a second exemplary configuration of the printing apparatus.

Another configuration of the printing apparatus 10 is described below. FIG. 2 represents a second exemplary configuration of the printing apparatus 10. In this embodiment, the printing apparatus 10 includes an inkjet head 12, a transfer belt 14, a counter heater 16, belt driving rollers 18 and 20, a transfer roller 22, and a fixing heater 34. In FIGS. 1 and 2, the same reference labels are used for the same or similar components, except for some points described below.

In the present embodiment, the inkjet head 12 ejects ink droplets of a latex ink. The latex ink is an example of the inks that contain a binder resin and a solvent. The latex ink is, for example, an aqueous latex ink. The aqueous latex ink is, for example, an ink in which an aqueous emulsion or an aqueous suspension of a resin has been formed. The ink may be, for example, an ink that contains water or a hydrophilic organic solvent, and a resin emulsified or suspended in the water or the hydrophilic organic solvent. In addition to the water or hydrophilic organic solvent, the ink may contain a non-hydrophilic organic solvent having an affinity for the hydrophilic organic solvent.

In the present embodiment, a part of the solvent (e.g., water) contained in the latex ink corresponds to the solvent removed by heating with the counter heater 16. The ink has a viscosity of for example, less than 20 mPa·sec before the part of the solvent is removed by heating. The counter heater 16 partially evaporates the solvent in the latex ink to make the ink viscosity 50 mPa·sec or more on the transfer belt 14. After the heating with the counter heater 16, the ink has a viscosity of 50 mPa·sec or more, preferably 100 mPa·sec or more, more preferably 500 mPa·sec or more. For example, any known latex ink having such viscosity properties may preferably be used in the present embodiment.

In the present embodiment, the fixing heater 34 serves as the image fixing unit. The fixing heater 34 is disposed in the downstream in the transport direction of the medium 50 after the image is transferred with the transfer roller 22, and heats the medium 50 to dry the ink on the medium 50. As used herein, "dry the ink on the medium 50" means, for example, sufficiently drying the ink to achieve the purpose of fixing the image to the medium 50. Preferably, for example, the fixing heater 34 heats the both sides of the medium 50 with the configuration shown in FIG. 2.

After intensive studies, the inventor of the present application found that partial evaporation of the solvent is sufficient, and the solvent does not need to be completely evaporated to bring the latex ink to a sufficiently high viscosity state. It is therefore possible also in the present embodiment to, for example, appropriately and sufficiently increase the viscosity of the ink on the transfer belt 14 with the counter heater 16. This makes it possible to appropriately transfer the image to the medium 50.

In the present embodiment, the remaining solvent in the ink may be evaporated by heating the medium 50 with the fixing heater 34 after the image is transferred. The heating dries the ink on the medium 50, and can appropriately fix the image. Image transfer printing can thus be appropriately performed also in the present embodiment, for example.

The phenomenon by which partial evaporation of the solvent sufficiently increases the latex ink viscosity is believed to be linked to, for example, the latex ink configuration containing larger resin particles as compared to other types of ink (such as solvent ink, UV curable ink, and solvent UV ink). Specifically, for example, the latex ink involves a relatively large frictional force between the ink resin particles, and, upon partially evaporating the solvent, this frictional force is believed to become greater than the force of the solvent acting to disperse the resin particles, and cause the resin particles to assemble or aggregate.

Specific examples of the resin contained in the latex ink include vinyl resin, acrylic resin, alkyd resin, polyester resin, polyurethane resin, silicone resin, fluoro resin, epoxy resin, phenoxy resin, polyolefinic resin, and modified resin thereof. Acrylic resin, water-soluble polyurethane resin, water-soluble polyester resin, water-soluble acrylic resin, natural rubber, and synthetic rubber are preferred, and acrylic resin is particularly preferred.

The resin contained in the latex ink may be used alone or in a combination of two or more. The resin may have any content depending on such factors as the type of the resin used, and is, for example, 1 weight % or more, preferably 2 weight % or more, and 20 weight % or less, preferably 10 weight % or less with respect to the total amount of the aqueous latex ink.

Another exemplary configuration of the printing apparatus 10 is described below. FIGS. 3A and 3B and FIGS. 4A to 4C are diagrams representing a third exemplary configuration of the printing apparatus 10. The printing apparatus 10 of the third example uses an ink that contains a binder resin (dispersoid), and a solvent (dispersion medium), as described below. The configuration of the printing apparatus 10 of this embodiment is the same as or similar to that of the printing apparatus 10 described with reference to FIG. 2, except for some points described below.

Figure 3A:
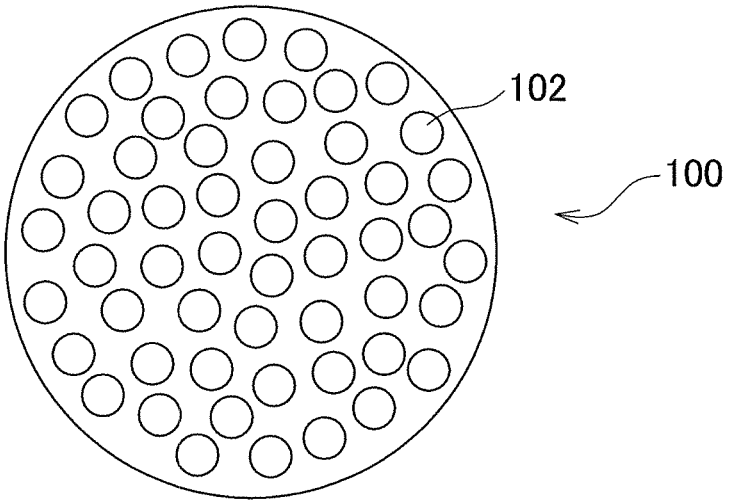
Figure 3B:
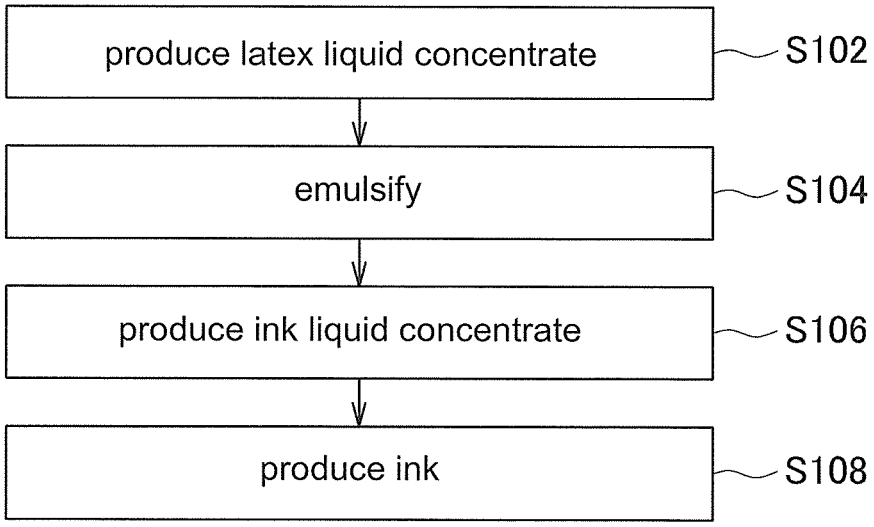

FIGS. 3A and 3B represent an example of the ink used in the third example, in which FIG. 3A shows an exemplary configuration of a binder resin 100 contained in the ink of the third example. In this embodiment, the inkjet head 12 (see FIG. 2) ejects an ink that contains the binder resin 100 (dispersoid), and a solvent (dispersion medium). The binder resin 100 in the ink is dispersed in the solvent, and a colorant 102 as an example of fine particles is dispersed or dissolved in particles of the binder resin 100.

The specific material of the binder resin 100 used in the ink of the present embodiment is not particularly limited, as long as it is not soluble in the vehicle, and is preferably at least one resin selected from high molecular weight compounds curable or cured by photo or heat polymerization. As used herein, "vehicle" refers to a component other than the binder resin 100 containing dispersed or dissolved fine particles such as the colorant 102 in the ink of the present embodiment, and is intended to include, for example, a solvent (dispersion medium), an additive, and a co-solvent.

The specific material of the binder resin 100 may be a monomer, an oligomer, or a low molecular weight resin that cures through polymerization reaction under heat or light, for example, by irradiation of energy rays such as ultraviolet light, electron beam, and radiation. For example, the binder resin 100 particles may be particles formed by emulsion polymerization or suspension polymerization of a binder resin material monomer and the colorant. In this way, for example, the binder resin 100 particles can easily be formed into substantially the shape of a sphere or an ellipsoid. The ejection stability through the inkjet heads also can be appropriately maintained, for example, even when the particle size of the binder resin 100 is increased.

More specific examples of the binder resin 100 include: water-soluble vinyl resin, acrylic resin, alkyd resin, polyester resin, polyurethane resin, silicone resin, fluoro resin, epoxy resin, phenoxy resin, polyolefinic resin, and modified resin thereof. Acrylic resin, water-soluble polyurethane resin, water-soluble polyester resin, and water-soluble acrylic resin are preferred, and acrylic resin is particularly preferred.

Other examples of the binder resin 100 include: natural rubber latex, styrene butadiene latex, styrene-acryl latex, and polyurethane latex. Preferably, these binder resins are used in the form of, for example, liquid concentrate either per se or after an emulsion polymerization reaction. In this way, the unpolymerized low viscosity liquid resin becomes more likely to form a spherical shape upon being dispersed in water. When using such a resin, the binder resin may be of a polymer-dispersion type that requires a dispersant, or a self-dispersion type (see JP-A-2001-152063 for reference).

The cured high molecular weight compounds may be, for example, various synthetic latexes, including, for example, natural rubber (natural rubber latex), polybutadiene (EBR latex), styrene-butadiene copolymer (SBR latex), acrylonitrile-butadiene copolymer (NBR latex), methylmethacrylate-butadiene copolymer (MBR latex), 2-vinylpyridine-styrene-butadiene copolymer (VP latex, vinylpyridine latex), polychloroprene (chloroprene latex), polyisoprene (IR latex), polystyrene (polystyrene latex), polyurethane (polyurethane latex, polyurethane emulsion), acrylate polymer (acryl latex, acrylate emulsion), polyvinyl acetate (vinyl acetate emulsion), vinyl acetate copolymer (such as vinyl acetate acryl emulsion), vinyl acetate-ethylene copolymer (such as EVA emulsion), acrylate-styrene copolymer (acrylstyrene emulsion), polyethylene (polyethylene emulsion), vinyl chloride copolymer (vinyl chloride latex), vinylidene chloride copolymer (vinylidene chloride latex), and epoxy (epoxy emulsion). These may be used alone or in combination. It is also possible to use a low glass-transition-point (TG) resin and a high TG, high-fastness resin in combination to improve the adhesion to the transfer belt 14 (see FIG. 2) or the medium 50 (see FIG. 2), and the fixability under low-temperature heat.

In the inks of the present embodiment, the average particle diameter of the binder resin 100 is preferably 300 nm or more, more preferably 400 nm or more. The average particle diameter of the binder resin 100 particles is the average particle diameter of the particles of the binder resin 100 dispersed in the dispersion medium. With this configuration, it is possible to appropriately prevent, for example, ink bleeding on the transfer image forming member, excess aggregation of the binder resin particles, and deterioration of the colorant while appropriately maintaining the ejection stability of the ink through the inkjet head. The binder resin particles may have an average particle diameter of, for example, 800 nm or more. With this configuration, for example, ink bleeding on the transfer image forming member can be more reliably prevented. Preferably, the average particle diameter of the binder resin 100 particles is no greater than 1/10 of the nozzle diameter of the inkjet head. With this configuration, for example, the ejection stability can be more appropriately improved. Preferably, the binder resin 100 particles are substantially in the shape of a sphere, an ellipsoid, or a disc. With this configuration, for example, the ink ejection stability can be more appropriately improved.

The concentration of the binder resin 100 particles in the ink may be appropriately set according to the intended use. For example, when dispersing pigment fine particles as the colorant 102 in the binder resin 100 particles, the binder resin 100 is preferably 5 volume % to 70 volume %, further preferably 7 volume % to 40 volume % with respect to the total ink amount.

The colorant 102 dispersed or dissolved in the binder resin 100 particles is not particularly limited, as long as it is not soluble in the vehicle, and may be selected from various colorants according to the intended use. Specifically, the colorant may be, for example, at least one particle selected from the group consisting of an organic pigment, an inorganic pigment, a disperse dye, an acidic dye, a reaction dye, titanium oxide, a magnetic particle, alumina, silica, ceramic, carbon black, a metal nanoparticle, and an organic metal. Examples of the metal nanoparticle material include gold, silver, copper, and aluminum. Titanium oxide may preferably be used to provide a white coating.

The average particle diameter of the colorant 102 is preferably 50 nm or less. With this configuration, for example, the coloring properties of the ink further improves, and more vivid printing can be performed. Because the colorant 102 is encapsulated in the binder resin particles, the lightfastness of the ink can appropriately improve even when the colorant average particle diameter is as small as 50 nm or less. The average particle diameter of the colorant 102 is more preferably 20 nm or less.

The method used to form the colorant 102 as a microparticulate of the foregoing particle diameter, or the method used to make fine particles of the colorant 102 may be appropriately selected according to the colorant of interest and the intended use from mechanical pulverization methods (such as using a roll crusher, a ball mill, a jet mill, a sand grinder mill, and an edge runner), crystallization methods (such as water crystallization, a hydrothermal method, and a thermal decomposition method), gas phase methods as represented by CVD (Chemical Vapor Deposition), and liquid phase methods (such as emulsion polymerization). Fine particles of a defined particle size distribution can be obtained by controlling the particles to be within a defined particle diameter distribution during their production, or classifying particles with a wide particle size distribution after the production.

In the ink of the present embodiment, for example, a plurality of colorant 102 particles is dispersed or dissolved in the binder resin 100 particles. Specifically, for example, 5 or more colorant 102 particles are preferably dispersed or dissolved. One or more kinds of colorant 102 may be dispersed or dissolved in the binder resin 100 particles. The average content ratio of the binder resin 100 and the colorant 102 in the binder resin 100 particles is preferably 20:80 to 95:5 by weight. With this configuration, for example, particle precipitation of the binder resin can be more appropriately suppressed.

The solvent is not particularly limited, as long as it does not dissolve the colorant 102, and a variety of dispersion media may be used depending on the intended use. A specific example of the dispersion medium is water. For its safety and environmental friendliness, water is preferable for use in applications such as common inkjet printer inks. Preferably, water is used with a moisturizer added thereto, because, when used alone, water dries quickly, and causes clogging of the inkjet head nozzles. It is more preferable to add an organic solvent to the water. In this way, it can quickly evaporate on the transfer belt 14 upon being heated with the counter heater 16 (see FIG. 2), and bleeding can be prevented. Aside from water, other solvents such as hydrophilic solvents may be used as the dispersion medium. It is also possible to use, for example, non-hydrophilic solvents for the purpose of, for example, viscosity adjustment.

When the main component of the dispersion medium is water and/or a hydrophilic solvent, it is preferable to treat the surface of the binder resin 100 by a hydrophilic treatment. With this configuration, the binder resin 100 particles desirably disperse in the dispersion medium because the particle surface of the binder resin 100 in contact with water or the hydrophilic solvent is given an affinity for water or the hydrophilic solvent. It is therefore possible with this configuration to prevent ink separation inside the nozzles, and reliably eject predetermined amounts of ink through the nozzles even when, for example, the particle diameter of the binder resin 100 is increased. The affinity for the dispersion medium is maintained by the hydrophilic binder resin surface. Accordingly, the materials selected for the binder resin 100 and the colorant 102 do not need to be hydrophilic, and various materials can be used for the binder resin 100 and the colorant 102.

Preferably, the hydrophilic treatment is, for example, an emulsification process that emulsifies the surface with an emulsifier, or a process that introduces a hydrophilic group to the surface. With this configuration, for example, the particle surface of the binder resin 100 can be appropriately rendered hydrophilic.

The ink of the present embodiment may contain an additive, in addition to the binder resin 100 particles containing the colorant 102, and the dispersion medium. The additive may be appropriately selected according to the intended use, and may be, for example, a surfactant, a coupling agent, a buffer, a biocide, a chelating agent, a viscosity adjuster, or a solvent. The additive may be dispersed in the binder resin 100 particles, or may exist in the dispersion medium, outside of the binder resin 100 particles.

The binder resin 100 itself may be colored with a dye, and used as the binder resin 100 particles. For example, a polyester resin encapsulating a disperse dye may be heated to dissolve the disperse dye and dye the resin, or a nylon resin mixed with an acidic dye or a reaction dye may be heated to dissolve the dye and dye the resin. These may then be used as the binder resin 100 particles. In this way, a clear, non-bleeding, vivid inkjet printing ink can be obtained.

In the ink of the present embodiment, a resin different from the binder resin 100 may be dissolved in the dispersion medium. With this configuration, for example, the ink viscosity can be more appropriately adjusted. Further, for example, when a resin capable of binding at least the latex particles, or a resin having a different glass transition point from that of the binder resin 100 is used, such an additional resin can serve as a binder, and the binder resin 100 can more strongly bind to each other when the ink on the medium 50 is dried to form a coating by the binding of the binder resin. This makes it possible to more appropriately fix the ink on the medium 50.

A method for producing the ink of the present embodiment is described below. FIG. 3B is a flowchart representing an example of the ink producing method of the present embodiment, in which the binder resin 100 is a heat-curable high molecular weight compound, the colorant 102 is a pigment fine particle, and the solvent (dispersion medium) is water. The following method also can be used to produce the ink when the binder resin 100 or other ink components have different configurations. In such a case, the method should be partially modified according to the type of the binder resin 100 and the other ink components used.

The ink producing method of the present embodiment begins with production of a liquid concentrate of the high molecular weight compound (step S102). Here in advance, for example, pigment fine particles to be dispersed in particles of the high molecular weight compound are added and dispersed in the liquid concentrate of the high molecular weight compound. Additives may be used depending on the intended use.

The pigment fine particles produced prior to step S102 may be produced using, for example, a build-up method. In the build-up method, the fine particles are produced from a solid-phase material (raw material) produced through the reaction, supersaturation, nucleation, and growth of gaseous or liquid phase materials, which are fed to the reaction at a high purity in terms of atoms, molecules, or ions. In industry, the method is used for the synthesis of high-purity fine particles with a particle diameter of several nanometers to several ten nanometers. The build-up method is described in, for example, Japanese Patent No. 3936558.

The liquid concentrate of the high molecular weight compound is emulsified (step S104). Step S104 may be performed using, for example, an apparatus configured from a container and an agitator. In this case, for example, the liquid concentrate of the high molecular weight compound formed of, for example, an unreacted monomer is charged into the container, and the agitator is charged with water or some other solvent for dispersing the high molecular weight compound particles. Thereafter, for example, the liquid concentrate is pumped from the container to the agitator through a pipe, and agitated at high speed with an agitating blade while being charged into the agitator. This forms an emulsion of spherical particles of controlled particle diameters in the liquid concentrate of the high molecular weight compound dispersed in the water or some other solvent.

Devices, such as ultrasonic agitators, used for emulsification and dispersion purposes also may be used for the emulsification, other than the mechanical agitators and dispersers. The liquid concentrate already contains the pigment in the form of a dispersion, and the pigment fine particles are dispersed in the particles of the liquid concentrate of the high molecular weight compound forming the emulsion. The viscosity of the liquid concentrate suppresses aggregation of the pigment fine particles in the liquid concentrate of the high molecular weight compound. The liquid concentrate of the high molecular weight compound can thus form particles in water with the pigment fine particles uniformly dispersed therein.

The liquid concentrate of the high molecular weight compound is emulsified or suspended to produce an ink liquid concentrate (step S106). In step S106, for example, the liquid concentrate may be emulsified or suspended by forming a rubber from the liquid concentrate through heating or polymerization reaction (using, for example, a crosslinker mixed in water). The emulsification or suspension of the liquid concentrate of the high molecular weight compound fixes the pigment fine particles in the high molecular weight compound particles, and completely prevents their reaggregation. It is not necessarily required to emulsify or suspend the liquid concentrate of the high molecular weight compound, and, in some cases, the next step may be performed with the particles of the liquid concentrate being dispersed in water.

Finally, the ink liquid concentrate obtained in step S106 is diluted to the desired concentration to obtain an ink of the desired concentration or viscosity (step S108). In step S108, additives may be added to adjust the ink surface tension, as appropriate.

Figure 4A:
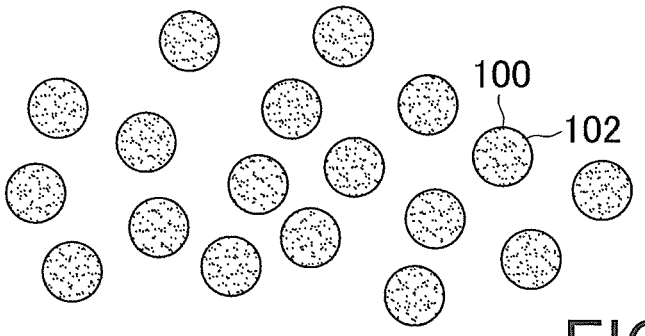
Figure 4B:
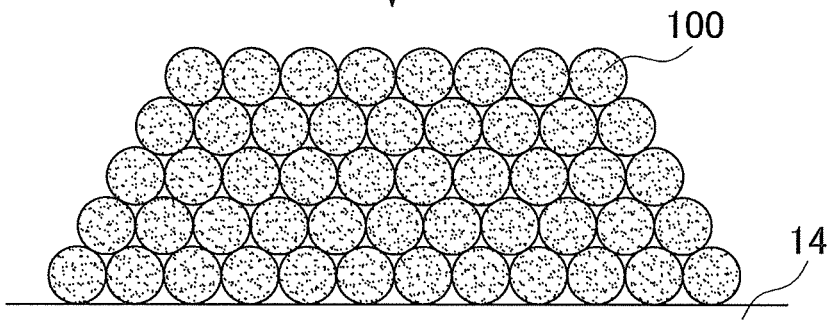
Figure 4C:
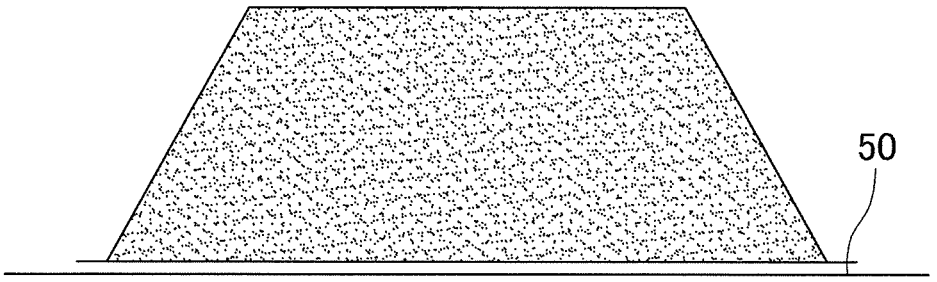

The following describes an example of ink states during the printing of the ink produced as above. FIGS. 4A to 4C represent a state of the ink in each step during a printing process. The printing may be performed, for example, with the printing apparatus 10 having the configuration same as or similar to that described with reference to FIG. 2. FIG. 4A shows a state of the ink before landing on the transfer belt 14. In this state, the binder resin 100 in the ink is dispersed in the dispersion medium.

FIG. 4B shows a state after the ink has landed on the transfer belt 14, and has been heated with the counter heater 16 (see FIG. 2). In this state, the binder resin 100 in the ink is layered on the transfer belt 14. By being heated with the counter heater 16, the dispersion medium contained in the ink has at least partially evaporated, and the ink viscosity has been increased.

Here, when the binder resin 100 is, for example, a heat-curable high molecular weight compound, the counter heater 16 heats the transfer belt 14 at a temperature that does not cure the binder resin 100 contained in the ink on the transfer belt 14. With this configuration, for example, the viscosity of the ink on the transfer belt 14 can be appropriately brought to a suitably transferable state. After the heating has increased the viscosity, the image created by the ink is transferred to the medium 50 with the transfer roller 22 and the like (see FIG. 2). The image is then fixed to the medium 50 by heating the medium 50 with the fixing heater 34 (see FIG. 2).

When the binder resin 100 is, for example, a heat-curable high molecular weight compound, the fixing heater 34 heats the medium 50 at least at a temperature equal to or greater than the curing temperature of the binder resin 100 contained in the ink on the medium 50. In this manner, the fixing heater 34 heats and cures the binder resin 100 in the ink to fix the image to the medium 50. Image transfer printing can thus be appropriately performed with this configuration, for example.

As an example, heating by the fixing heater 34 may heat the medium 50 at higher temperatures to melt the cured binder resin 100 and fix the image to the medium 50. FIG. 4C represents a state of the ink heated with the fixing heater 34 at a temperature that melts the cured binder resin 100. In this case, the counter heater 16, before the transfer, heats the ink on the transfer belt 14 at a temperature below the temperature that melts the binder resin 100. After the transfer, the fixing heater 34 heats the ink on the medium 50 at a temperature equal to or greater than the melting temperature. With this configuration, for example, the binder resin fuses after being melted by the heating with the fixing heater 34. The fused binder resin fixes to the medium 50 after cooling to a certain temperature following the heating. With this configuration, the image can be more strongly fixed to the medium 50. This makes it possible to more appropriately perform image transfer printing, for example.

Depending on the purpose of printing or use, resins other than heat-curable high molecular weight compounds may be used as the binder resin 100. For example, an ink may be used that dries and fixes to the medium 50 without having the binder resin 100 cured. In this case, for example, the counter heater 16, before the transfer, partially evaporates the dispersion medium in the ink to increase the viscosity of the ink on the transfer belt 14. After the transfer, the fixing heater 34 evaporates the remaining dispersion medium in the ink to fix the image to the medium 50.

Figure 5A:
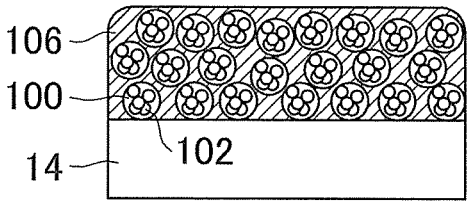
Figure 5B:
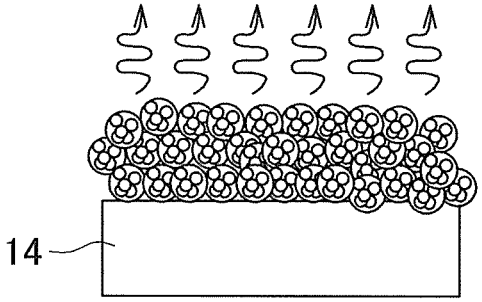
Figure 5C:
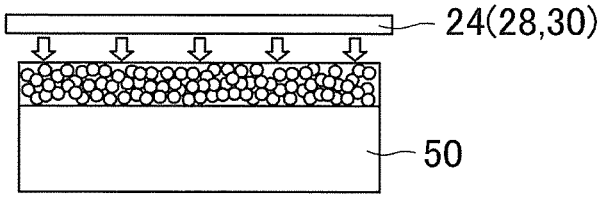

For example, a high molecular weight compound that is cured by irradiation of a light such as ultraviolet light may be used as the binder resin 100. FIGS. 5A to 5C represent a state of the ink in each step during a printing process when a high molecular weight compound that is cured by UV irradiation is used as the binder resin 100. The printing may be performed, for example, with the printing apparatus 10 having the configuration same as or similar to that described with reference to FIG. 1.

FIG. 5A represents an example of a state immediately after the ink has landed on the transfer belt 14. Here, the ink on the transfer belt 14 contains the binder resin 100 being dispersed in a solvent 106 (dispersion medium).

FIG. 5B represents an example of a state after the ink has been heated with the counter heater 16 (see FIG. 1). Heating by the counter heater 16 evaporates the solvent 106 in the ink, and only the binder resin 100 remains on the transfer belt 14 with the colorant 102 encapsulated in the binder resin 100. As a result, the ink viscosity increases. With this configuration, the ink viscosity can be appropriately brought to a suitably transferable state without curing the ink with the counter heater 16 on the transfer belt 14. After the ink viscosity has increased, the image on the transfer belt 14 is transferred to the medium 50 with the transfer roller 22 and the like (see FIG. 1).

FIG. 5C represents an example of an ink state after UV irradiation with the strong UV irradiator 24 and the like. By being irradiated with the strong UV light on the medium 50, the binder resin 100 cures, and strongly fixes to the medium 50. This makes it possible to fix a glossy, strong ink coating on the medium 50. Image transfer printing can be appropriately performed also with this configuration.

While the embodiments of the present invention have been discussed in the foregoing detailed explanation, the technical scope of the present invention is not limited by the description of the embodiments above, and the embodiments may be altered or improved in many ways, as would be obvious to a person of ordinary skill in the art. An embodiment based on such alterations and improvements is encompassed in the technical scope of the present invention, as would be obvious from the appended claims.

The present invention can preferably be used for, for example, printing apparatuses.

What is claimed is:

1. A printing apparatus for performing an image transfer printing, and the printing apparatus comprising:

a transfer image forming member on which a transfer image is created, and the transfer image is an image to be transferred to a medium;

an inkjet head that ejects ink droplets to the transfer image forming member using an inkjet scheme, so as to create the transfer image on the transfer image forming member;

a heating member that heats the transfer image forming member;

a transfer member that transfers the transfer image created on the transfer image forming member to the medium; and an image fixing unit that fixes the image which is transferred to the medium with the transfer member to the medium, wherein the inkjet head ejects ink droplets of an ink containing a solvent that is removed by heating with the heating member, and wherein the ink has a viscosity of 50 mPa·sec or more after the solvent is removed by heating with the heating member, from the ink droplets landed on the transfer image forming member, wherein the ink has a viscosity that makes the ink non-bleedable on the transfer image forming member and transferable to the medium after the solvent is removed by heating with the heating member, from the ink droplets landed on the transfer image forming member;

the ink is a solvent UV ink, containing: a UV polymerizable substance and an organic solvent, the organic solvent being removed by heating with the heating member, from the ink droplets of the ink landed on the transfer image forming member, and the UV polymerizable substance is in a state that isn't cured, wherein the image fixing unit is a UV light source that emits a ultraviolet light, and the image transferred to the medium with the transfer member is UV irradiated with the image fixing unit to cure the ink on the medium.

2. The printing apparatus according to claim 1, wherein the medium is a paper.

3. A printing apparatus for performing an image transfer printing, and the printing apparatus comprising:

a transfer image forming member on which a transfer image is created, and the transfer image is an image to be transferred to a medium;

an inkjet head that ejects ink droplets to the transfer image forming member using an inkjet scheme, so as to create the transfer image on the transfer image forming member;

a heating member that heats the transfer image forming member;

a transfer member that transfers the transfer image created on the transfer image forming member to the medium; and an image fixing unit that fixes the image which is transferred to the medium with the transfer member to the medium, wherein the inkjet head ejects ink droplets of an ink containing a solvent that is removed by heating with the heating member, and wherein the ink has a viscosity of 50 mPa·sec or more after the solvent is removed by heating with the heating member, from the ink droplets landed on the transfer image forming member, wherein the ink has a viscosity that makes the ink non-bleedable on the transfer image forming member and transferable to the medium after the solvent is removed by heating with the heating member, from the ink droplets landed on the transfer image forming member;

wherein the ink is an ink containing a binder resin and a solvent, and wherein the heating member at least partially evaporates the solvent contained in the ink to increase the viscosity of the ink on the transfer image forming member, wherein the binder resin in the ink is dispersed as a dispersoid in the solvent which serves as a dispersion medium, and wherein a colorant is dispersed or dissolved in particles of the binder resin.

4. The printing apparatus according to claim 3, wherein the binder resin is a heat-curable high molecular weight compound, wherein the heating member heats the transfer image forming member at a temperature that does not cure the binder resin in the ink on the transfer image forming member, and wherein the image fixing unit heats the medium at a temperature equal to or greater than a curing temperature of the binder resin in the ink on the medium.

5. The printing apparatus according to claim 3, wherein the heating member heats the ink on the transfer image forming member to a temperature below a melting temperature that melts the binder resin, and wherein the image fixing unit heats the ink on the medium to a temperature equal to or greater than the melting temperature.

6. The printing apparatus according to claim 3, wherein the binder resin is a high molecular weight compound that is cured by being irradiated with a light, and wherein the image fixing unit irradiates the medium with the light to cure the binder resin in the ink on the medium.

7. A printing method for performing an image transfer printing, and the printing method comprising:

ejecting ink droplets with an inkjet head using an inkjet scheme to a transfer image forming member on which a transfer image is created, and the transfer image is an image to be transferred to a medium, and creating the transfer image on the transfer image forming member;

heating the transfer image forming member with a heating member;

transferring the transfer image created on the transfer image forming member to the medium by using a transfer member; and fixing the image which is transferred to the medium with the transfer member to the medium by using an image fixing unit, wherein the inkjet head ejects ink droplets of an ink containing a solvent that is removed by heating with the heating member, and wherein the ink has a viscosity of 50 mPa·sec or more after the solvent is removed by heating with the heating member, from the ink droplets landed on the transfer image forming member, wherein the ink has a viscosity that makes the ink non-bleedable on the transfer image forming member and transferable to the medium after the solvent is removed by heating with the heating member, from the ink droplets landed on the transfer image forming member, the ink is an ink containing a binder resin and a solvent, and wherein the binder resin in the ink is dispersed as a dispersoid in the solvent which serves as a dispersion medium, and wherein a colorant is dispersed or dissolved in particles of the binder resin.

* * * * *